US005439137A

United States Patent [19]

Grollier et al.

[11] Patent Number: 5,439,137

[45] Date of Patent: Aug. 8, 1995

[54] METHOD FOR FORMING AN EXTEMPORANEOUS MIXTURE OF AT LEAST TWO LIQUID OR PASTY COMPONENTS, AND PRESSURIZED CAN FOR IMPLEMENTING SUCH A METHOD

[75] Inventors: Jean-Francois Grollier, Paris; Daniel Bauer, le Raincy, both of France

[73] Assignee: L'Oreal, Paris, France

[21] Appl. No.: 157,032

[22] PCT Filed: Apr. 6, 1993

[86] PCT No.: PCT/FR93/00347

§ 371 Date: Dec. 1, 1993

§ 102(e) Date: Dec. 1, 1993

[87] PCT Pub. No.: WO93/21085

PCT Pub. Date: Oct. 28, 1993

[30] Foreign Application Priority Data

Apr. 9, 1992 [FR] France ..... 92 04341

[51] Int. Cl.[6] ..... B67D 5/52

[52] U.S. Cl. ..... 222/1; 222/135; 222/145.1; 222/394

[58] Field of Search ..... 222/129, 130, 145, 394–399

[56] References Cited

U.S. PATENT DOCUMENTS

| | | | |
|---|---|---|---|
| 3,630,415 | 12/1969 | Morane et al. . | |
| 3,635,261 | 1/1972 | Morane et al. | 222/130 X |
| 3,815,793 | 6/1974 | Morane et al. | 222/399 |
| 3,995,778 | 12/1976 | Gamadia | 222/399 |
| 4,399,158 | 8/1983 | Bardsley et al. | 222/145 X |
| 4,456,155 | 6/1984 | Miyata et al. | 222/396 |
| 4,518,082 | 5/1985 | Ye | 206/217 |
| 4,995,533 | 2/1991 | Vandoninck | 222/399 X |
| 5,011,047 | 4/1991 | Cruysberghs | 222/399 |
| 5,082,146 | 1/1992 | Hardt | 222/135 |
| 5,110,014 | 5/1992 | Doundoulakis | 222/396 |
| 5,285,931 | 2/1994 | Alfons | 222/130 X |

FOREIGN PATENT DOCUMENTS

| | | | |
|---|---|---|---|
| 0349053 | 1/1990 | European Pat. Off. . | |
| 0446973 | 9/1991 | European Pat. Off. . | |
| 1959925 | 6/1970 | Germany . | |
| 2/16435 | 10/1992 | WIPO | 222/95 |

*Primary Examiner*—Andres Kashnikow
*Assistant Examiner*—Kenneth R. DeRosa
*Attorney, Agent, or Firm*—Young & Thompson

[57] ABSTRACT

In order to form an extemporaneous mixture of two components (S, A) isolated from each other, the first component (S) is placed in a can (1) in which a resupply capsule (5) under relatively high pressure is disposed, a valve (12) being provided and controlled depending on the value of the ambient pressure relative to a reference pressure. The second component (A) is introduced into the capsule (5), before installing this capsule in the can; the can (1), is put under a pressure by propellent gas (4) sufficient for the valve (12), during storage, and even though the capsule (5) has been brought into service, to remain in the closed state; in order to form the mixture of the components (S and A), by actuating the dispensing head (1), a reduction is brought about in the pressure in the can (1) placed in a position such that only propellent gas escapes from the dispensing head, which causes the valve (12) to open, the component (A) contained in this capsule to escape and to be mixed with the component (S) from the aerosol can.

6 Claims, 3 Drawing Sheets

METHOD FOR FORMING AN EXTEMPORANEOUS MIXTURE OF AT LEAST TWO LIQUID OR PASTY COMPONENTS, AND PRESSURIZED CAN FOR IMPLEMENTING SUCH A METHOD

The invention relates to a method for forming an extemporaneous mixture of at least two liquid or pasty components, kept during storage in closed compartments, isolated from each other, the first component being placed in a can intended to be put under pressure by a propellent gas, in which can is disposed a capsule of the capsule type ensuring resupply with propellent gas.

Resupply capsules are known from EP-A-0,349,053 and EP-A-0,446,973. Such a capsule comprises a chamber intended to receive a fluid under relatively high pressure, a valve provided in a wall of said chamber, means for controlling the valve which are suitable for bringing about the opening of the valve and for allowing fluid under pressure to escape when the capsule is in an environment at a pressure lower than a reference value corresponding to the operating pressure of the aerosol can.

In the case of a capsule in accordance with EP-A-0,349,053, the means for controlling the valve, when the capsule is not brought into service, are isolated from the ambient pressure by means of a plug seal which is meltable at low temperature or is able to be dissolved in the liquid from the aerosol can. The melting or dissolving of this plug seal brings the capsule into service.

In the case of a capsule in accordance with EP-A-0,446,973, the valve includes a rod which occupies a first closed position, when the capsule is not in service and when the ambient pressure is lower than the reference pressure; in order to bring the capsule into service, the rod is passed into a second closed position obtained when the ambient pressure is higher than the reference pressure. Once the capsule is in service, if the ambient pressure becomes lower than the reference pressure, the valve opens and allows gas under pressure, coming from the chamber of the capsule, to escape. For this second type of valve, bringing the capsule into service is accompanied by the valve passing, for a short time, via its open position located between the two closed positions, and by a tiny escape of gas under pressure.

Such capsules, as described in the documents mentioned, are used for pressurizing an aerosol can and for ensuring resupply with propellent gas, inside the can, progressively with the use of this aerosol can. Regulation is ensured by the means for controlling the valve which let some gas under pressure, coming from the capsule, escape in order to reestablish the desired pressure inside the aerosol can.

Surprisingly, the purpose of the invention is the application of a capsule of this type for the formation of an extemporaneous mixture of at least two components in a pressurized can.

It is known that the problem of extemporaneous mixing relates, in particular, to forming oxidation dyes for hair. During storage, a first component, constituted for example by a mixture of an oxidation dye in an ammoniacal medium in a vehicle is kept separated from a second component constituted by a hydrogen peroxide solution. At the time of treating the hair, the operator has to form the mixture of the two components there and then in order to obtain the oxidation dye.

Various solutions have already been proposed in this respect, for example by FR-A-2,289,407 or FR-A-2,453,793.

Although the solutions provided make it possible to keep separate the components to be mixed and to form the mixture at the time of use, they remain relatively tricky to employ. Furthermore, they do not make it possible to obtain a mixture in a pressurized can, in particular in the form of an aerosol.

The object of the invention, above all, is to provide a method for forming an extemporaneous mixture of at least two liquid or pasty components, such as defined above, which makes it possible to obtain the mixture, in a simple and rapid manner, in a pressurized can.

According to the invention, a method for forming an extemporaneous mixture of at least two liquid or pasty components, kept during storage in closed compartments, isolated from each other, the first component being placed in a can intended to be put under pressure by a propellent gas, in which can is disposed a resupply capsule comprising a chamber intended to receive a fluid under relatively high pressure, a valve provided in a wall of said chamber and means for controlling the valve depending on the value of the ambient pressure relative to a reference pressure, is characterized by the fact:

- that the second liquid or pasty component is introduced into the chamber of the capsule receiving the fluid under relatively high pressure and that the capsule thus formed is installed in the can;
- that the can is put under a pressure by propellent gas sufficient for the valve, during storage, and even though the capsule has been brought into service, to remain in the closed state;
- and that, at the time of use, the user, by actuating the dispensing head of the pressurized can, brings about a reduction in the pressure of the propellent gas in the can in order to form the mixture of the components, which can is placed in a position such that only propellent gas escapes from the dispensing head, this action causing the valve of the capsule to open, the liquid or pasty component contained in this capsule to escape and to be mixed with the component from the can.

Advantageously, the capsule includes a valve fitted with a rod which is able to occupy two separate closed positions corresponding respectively to an ambient pressure of the order of the atmospheric pressure and an ambient pressure at least equal to the operating pressure of the can, passing from one position to the other taking place via a transient open position of the valve.

Preferably, the capsule is disposed valve down and rod facing upward, so that the liquid contained in this capsule is expelled at the time of extemporaneous mixing.

As a variant, the capsule may be of the type having a plug seal which is meltable or soluble in an ambient liquid, with a view to bringing into service.

The can may be of the type having a plunger tube; at the time of extemporaneous mixing, the user places the can head down and presses the push-button in such a manner as to make propellent gas escape from the can. The can may lack a plunger tube and be intended to be used head down; at the time of formation of the extemporaneous mixture, the user holds the can head up and presses the dispensing head in order to make propellent gas escape and to bring about mixing, and thereafter, when the mixture has been formed and shaken, the user returns the can for use-head down and for dispensing the product.

A plurality of capsules may be placed in the can; each capsule may include one component intended to be mixed with the component from the can.

Advantageously, the can includes two capsules, one of which is intended solely to supply one of the liquid components of the mixture and the other of which contains only gas under pressure and is intended to maintain the pressure in the can, in particular during storage.

The invention also relates to a pressurized can for the implementation of the method. The can contains a first liquid or pasty component, put under pressure by a propellent gas, and a resupply capsule comprising a chamber intended to receive a fluid under relatively high pressure, a valve provided in a wall of said chamber and means for controlling the valve depending on the value of the ambient pressure relative to a reference pressure, the can being characterized by the fact that the capsule placed inside contains, in the chamber under relatively high pressure of fluid, a second liquid or pasty component intended to be mixed with said first component, the whole assembly being such that, for storage, the pressure of the propellent gas is sufficient to keep the valve closed so that the component from the capsule remains separated from said first component, whereas, at the time of use, an induced drop in pressure of the propellent gas in the can allows the capsule to be drained of its liquid component and the mixture to be formed.

The can may contain a plurality of capsules, in particular two resupply capsules, each capsule containing a different liquid component, in order to form a three-component mixture.

In the case of a two-component mixture, the can may contain two resupply capsules, one of which contains the second liquid component and the other of which contains only gas under pressure, in order to ensure resupply of the can in the event of slight leakages during storage, the reference pressure of the second capsule being slightly higher than that of the first capsule.

The invention consists, apart from the arrangements explained hereinabove, of a number of other arrangements which will be dealt with more explicitly hereinbelow in connection with exemplary embodiments described with reference to the appended drawings, but which are in no way limiting.

FIG. 1 of these drawings is a diagrammatic axial vertical section of a pressurized can formed in accordance with the invention in order to extemporaneously prepare a mixture of two liquid or pasty components kept during storage isolated from each other.

Figure 5:
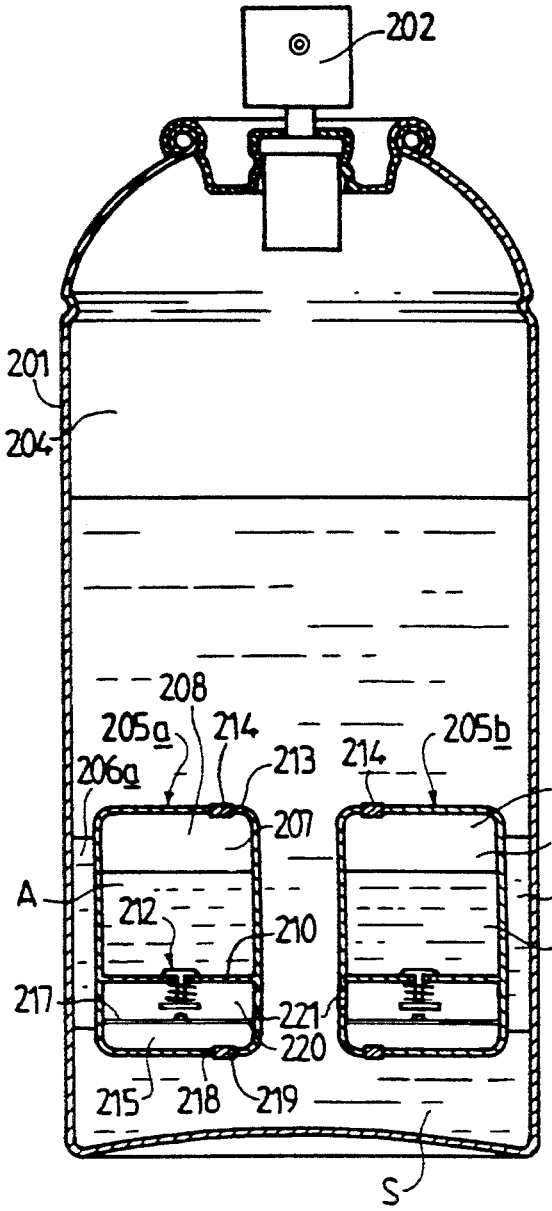
FIG. 5 is a vertical axial section of the manufactured pressurized can which can be stored.
Figure 6:
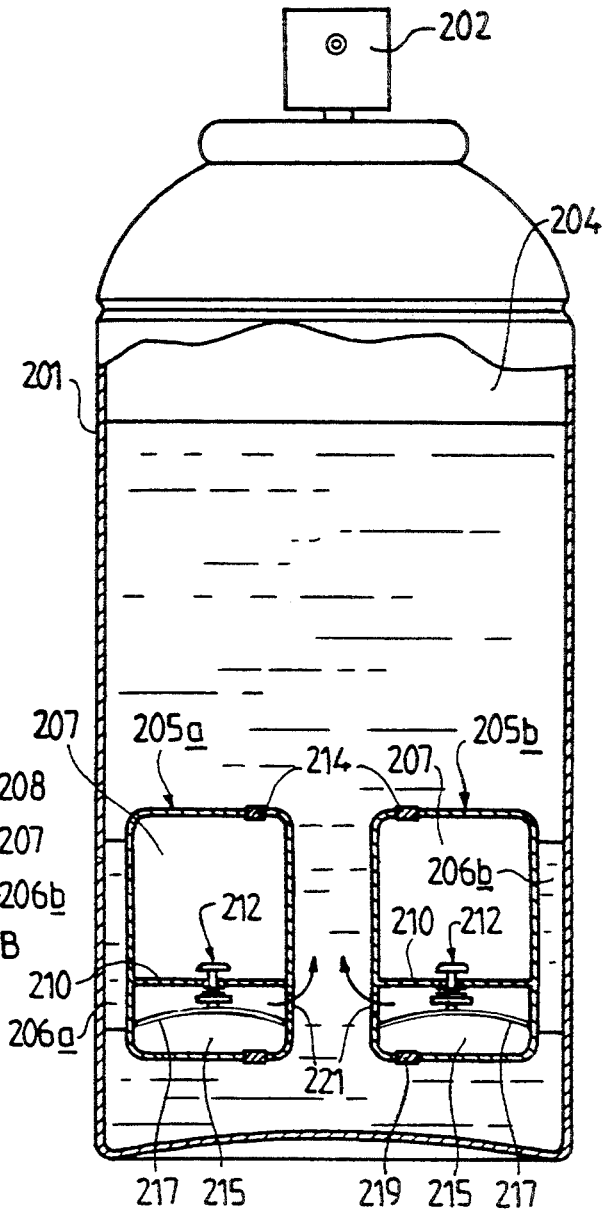

Finally, FIG. 6 represents the can of FIG. 5 when the operator has formed the extemporaneous mixture, with a view to its use.

Figure 1:
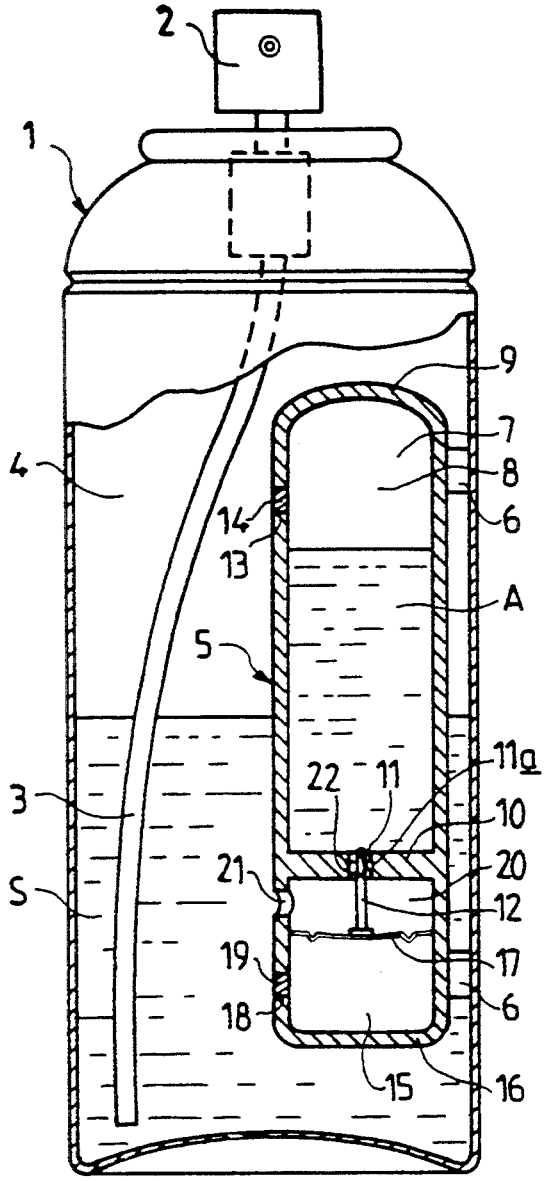

Referring to FIG. 1, a pressurized can 1 may be seen equipped with a dispensing head with a push-button 2, this can being fitted with a plunger tube 3 extending as far as the vicinity of the bottom of the can. The can 1 contains a liquid or pasty component S, constituted for example by a mixture of products. The component S is under the pressure of a gas 4 which lies above the liquid S inside the container 1. The initial pressure of the gas 4, before any dispensing of the product S, is sufficient to ensure correct dispensing, especially correct spraying. This pressure may be higher than $7\times10^5$ Pa and be of the order of $8\times10^5$ Pa.

The can 1 furthermore contains a resupply capsule 5 of the type of that described in EP-A-0,446,973. The capsule 5 is kept in the desired vertical position, valve down, inside the can 1, with the aid of retention means 6 interacting with the inner wall of the can 1. The capsule 5 will now be briefly described; for further details, it suffices to refer to EP-A-0,446,973. The capsule 5, of cylindrical general shape, includes a chamber 7 intended to receive a gas 8 under a high pressure, for example higher than $30\times10^5$ Pa, significantly higher than the initial pressure of the gas 4. The chamber 7 is closed, on one side, by means of an outwardly convex end 9, and, at its other end, by means of a transverse wall 10 fitted with a central opening 11 equipped with an O-ring seal **11*a* suitable for interacting with the rod 12 of a valve. The cylindrical wall of the chamber 7 includes an opening 13 intended for filling the chamber 7, which opening is thereafter closed by means of a plug seal 14** when the filling has been completed.

Another chamber 15 is provided at the other axial end of the capsule 5. This chamber 15 lies between the bottom 16 of the capsule 5 and a deformable transverse wall 17 constituted for example by a diaphragm. An opening 18 is provided in the cylindrical wall of the chamber 15 in order to fill it with gas, this opening 18 being thereafter closed by means of a plug seal 19. The diaphragm 17 carries, at its center, the valve rod 12. This rod 12, oriented along the axis of the capsule, is substantially orthogonal to the diaphragm 17. The gas introduced into the chamber 15 is put under a reference pressure which is slightly lower than the initial pressure of the propellent gas in the can 1. In the example in question, the reference pressure in the chamber 15 is of the order of $7\times10^5$ Pa, while the initial pressure of the propellant in the can 1 is of the order of $8\times10^5$ Pa. The diaphragm 17 is located some distance from the wall 10 so as to define an intermediate chamber or volume 20 which communicates, via an orifice 21 provided in the cylindrical wall of the capsule 5, with the space surrounding this capsule. The rod 12, toward its end remote from the diaphragm 17, includes an undercut 22 in the shape of a diabolo top, that is to say in the shape of two frustoconical surfaces Joined by their small bases. The capsule 5 and the valve produced by the rod 12, the diaphragm 17 and the central opening 11 fitted with the seal **11*a*** are arranged so that:

- when the pressure in the intermediate chamber 20 is lower than the reference pressure prevailing in the chamber 15, the rod 12 closes the opening 11 by means of one area of this rod located between the undercut 22 and the diaphragm 17;
- when the pressure in the chamber 20 is sufficiently high (higher than the reference pressure in the chamber 15), the rod 12 closes the opening 11 by means of its end located beyond the undercut 22 relative to the diaphragm 17, this corresponding to bringing the capsule 5 into service.

When the capsule is in service, if a reduction in pressure occurs in the chamber 20, the rod 12, under the action of the pressure in the chamber 15, tends to move toward the convex end 9 of the capsule so that the undercut 22 comes level with the seal 11*a* and creates a passage allowing the fluid contained in the chamber 7 to escape. When this fluid is gas 8 under high pressure, leakage continues until the pressure in the chamber 20, and therefore in the can 1, has resumed a value sufficient to bring the rod 12 back into a closed position.

As may be seen in FIG. 1, the capsule 5 is kept in the can 1, by the means 6, with its axis substantially parallel to the axis of the can 1, the chamber 7 facing the side of the push-button 2, whereas the chamber 15 faces toward the bottom of the can 1.

According to the invention, a second liquid or pasty component A is introduced into the chamber 7 of the capsule before putting this chamber under pressure with the aid of the gas 8 and closing by means of the plug seal 14. The opening 13 is remote from the wall 10, and relatively near the top 9 so as to be located above the level of the liquid A.

In the capsule 5 thus prepared, the chamber 7 contains two phases, a liquid one corresponding to the component A and a gaseous phase corresponding to the gas 8 for resupplying the can 1 with propellent gas. The chamber 15 is put under the reference pressure. The rod 12 is in the storage position, defined previously.

The capsule 5 is installed in the can 1 containing the liquid mixture S. Thereafter, the can 1 is closed and put under pressure by propellent gas 4, for example by injection through the push-button 2. Putting the can 1 under pressure causes the intermediate chamber 20 to be put under pressure so that the diaphragm 17 deforms and the rod 12 passes into the position for closing off the opening 11 by means of its end remote from the diaphragm 17. The capsule 5 is brought into service.

The can 1 may be stored, the components A and S being isolated from each other.

When the operator desires to form the mixture of the components A and S with a view to immediate use of the mixture, for example as an aerosol if the viscosity of the mixture is that of a liquid, the following operations are carried out.

Firstly, in order to activate the device, the operator turns the can 1 upside down so that the push-button 2 is located at the bottom and so that the end of the tube 3 is in the area occupied by the propellent gas 4. With the can upside down in this position, the operator presses the push-button 2 so as to make propellent gas 4 escape from the can 1, for a sufficient time, for example approximately 5 seconds.

This leakage of gas 4 brings about a pressure reduction inside the can 1 and the intermediate chamber 20 of the capsule.

The operator then places the can 1 back in its normal use position, head up.

On account of the pressure reduction in the can 1 and the intermediate chamber 20, the valve produced by the rod 12 and the opening 11 has opened and the liquid A, which is at the lower part of the chamber 7, flows out through the opening 11 into the chamber 20 and, through the opening 21, into the can 1 in order to be mixed with the component S.

The liquid product A drains completely into the can 1. It is to be noted that the volume of liquid A is small compared to the volume occupied by the gas 4 in the can 1. In other words, the complete draining of the liquid A is insufficient to bring about a pressure rise in the can 1 which would bring about the closure of the valve before complete draining of the liquid A.

After all the liquid A has flowed out from the chamber 7, part of the gas 8 under high pressure, contained in this chamber, escapes through the opening 11 and brings about a pressure rise in the can 1 and the chamber 20 until the valve closes.

The mixture of the liquids A and S may be improved by shaking the can 1, which is then ready to be used.

The can 1 is used in the head-up position. By pressing the push-button 2, the operator causes the mixture, S and A, thrust by the propellent gas 4 to escape through the plunger tube 3 and a spray nozzle. Progressively with the pressure reduction of the propellent gas 4 in the can 1, resupply with gas is ensured by the capsule 5, in a known manner.

It is clear that, with the method of the invention, it is possible to produce an extemporaneous mixture of a number of components greater than two.

Figure 2:
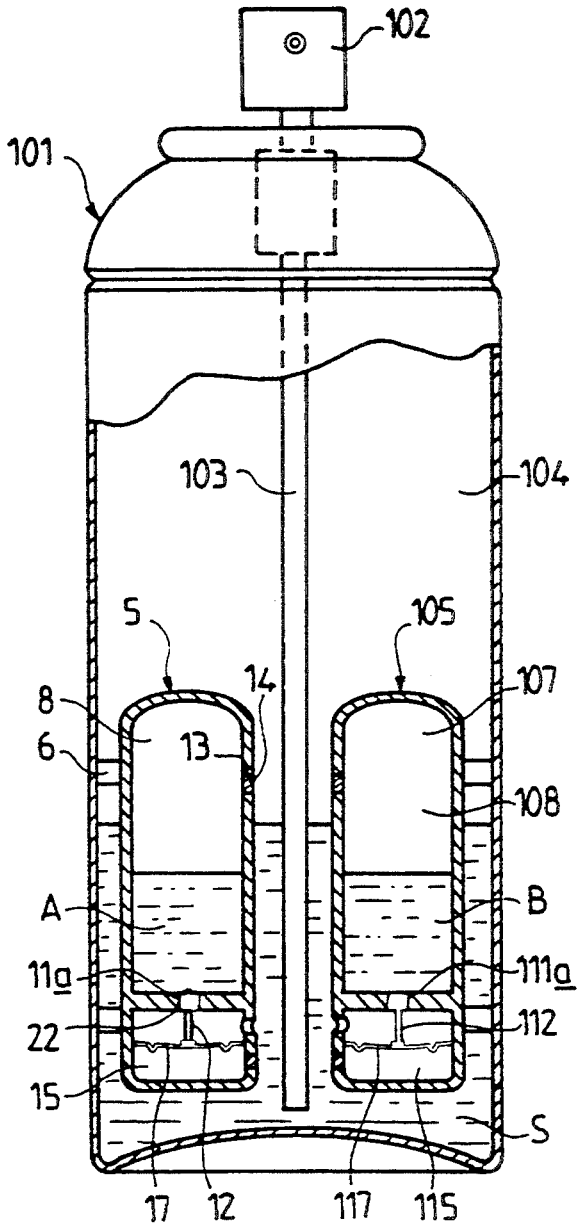
FIG. 2 is a sectional diagram, similar to that of FIG. 1, showing a pressurized can allowing an extemporaneous mixture of three components to be formed.
Figure 3:
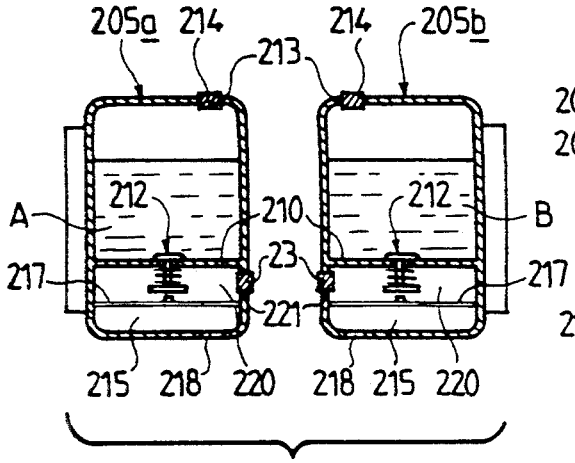
FIG. 3 is an axial section of a variant embodiment of two resupply capsules each containing a different component.

Referring to FIG. 2, a pressurized can 101 may be seen, in particular, arranged so as to allow the formation of an extemporaneous mixture of the liquid component S contained in the can 101 with two other liquid components A and B introduced respectively into a capsule 5 and a capsule 105, both placed inside the can 101, on either side of the plunger tube 103 which is substantially coaxial with the can.

The capsule 105 is prepared in the same manner as had been described in connection with the capsule 5, with the sole difference that the liquid component B is introduced into the chamber 107 of the capsule 105.

During storage, the can 101 is kept in the vertical position, head up, and the liquid components S, A and B are isolated from each other.

When it is desired to form the mixture of the three components, the procedure is as described previously, that is to say the can 101 is turned upside down, head down, and a reduction in the pressure of propellent gas in this can 101 is brought about by pressing the push-button 102 for a sufficient time, of the order of seconds.

Thereafter, the can 101 is placed back in its normal head-up position and the capsules 5, 105 are completely drained of their liquids A, B which are mixed with the component S, which mixing may be facilitated by shaking the can 101.

The whole assembly is then ready to be used for spraying the mixture, if it is a fluid liquid, in the form of an aerosol, or for dispensing under pressure if it is a paste or cream.

It is to be noted that, in the case where the mixture is to be formed between two components only, for example between S and A, as illustrated in FIG. 1, it is possible to provide a second capsule such as 105, lacking a liquid component, and serving solely as a gas reservoir in order to compensate for possible gas losses during storage. In this case, the reference pressure in the chamber 115 of the capsule 105 would be chosen slightly higher than the reference pressure of the chamber 15 in the capsule 5.

FIGS. 3 to 6 illustrate the implementation of the method of the invention with two resupply capsules 205*a*, 205*b* of the type of those described in EP-A-0,349,053. The two capsules 205*a*, 205*b* are identical and it will suffice to describe briefly the capsule 205*a*.

In the capsule 205*a* are encountered the main elements of the capsule 5 described in connection with FIG. 1, these being designated by numerical references equal to the sum of the number 200 and the reference used in FIG. 1 to designate elements playing similar roles.

The difference between the capsule 205*a* and the capsule 5 lies in the arrangement of the valve 212 constituted by a kind of clapper returned by a spring into the closed position. Furthermore, the opening 221 of the chamber 220 is closed, during storage of the capsule 205*a* in ambient air, by a plug seal 23 formed from a material capable of melting at a relatively low temperature, or capable of being dissolved in the liquid component S of the can 201.

During the storage or handling of the capsule 205*a* in ambient air, the closed chamber 220 is at a sufficient pressure, slightly higher than the reference pressure of the chamber 215 (for example, if the reference pressure in the chamber 215 is $7\times10^5$ Pa, the pressure in the chamber 220 is of the order of $8\times10^5$ Pa). Under these conditions, the diaphragm 217 remains sufficiently distant from the rod of the valve 212 so as not to cause it to open.

On the other hand, if the pressure in the chamber 220 falls, the diaphragm 217 assumes a shape which is convex toward the wall 210 and pushes back the rod of the valve 212 which opens as illustrated in FIG. 6.

When the pressure in the chamber 220 rises, the diaphragm 217 comes back substantially into a plane, which allows the valve 212 to close.

In accordance with the invention, the chamber 207 of the capsule 205*a* contains not only gas 208 under high pressure, but also a liquid component A.

In a similar manner, the capsule 205*b* includes a chamber 207 which contains a liquid component B in addition to the resupply gas.

Figure 4:
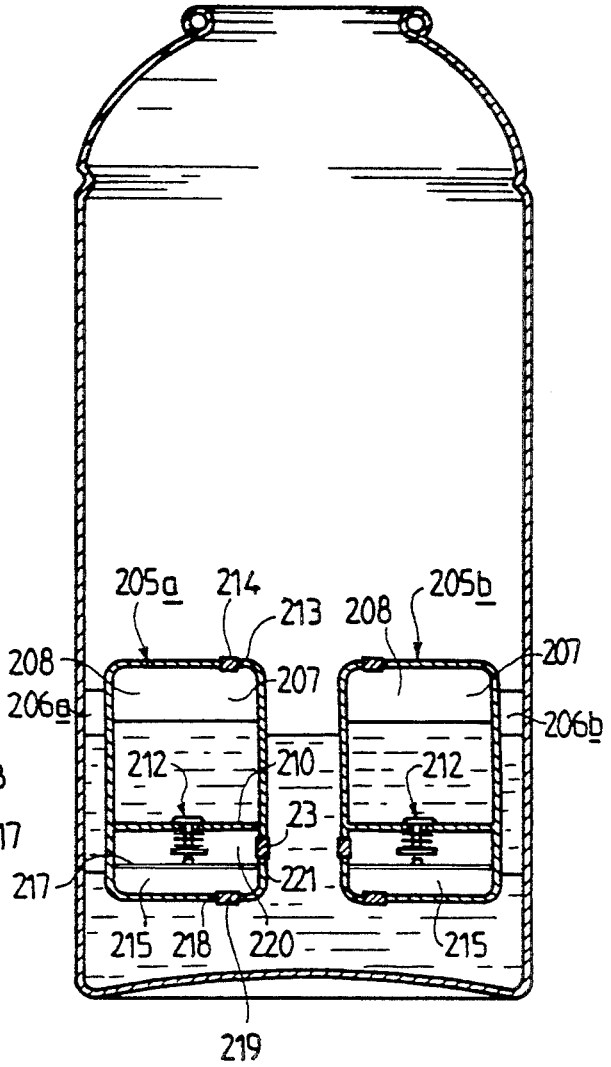
FIG. 4 illustrates a phase of manufacture of the can after installing resupply capsules in the can, before putting the can under pressure.

During the preparation of the can 201, as illustrated in FIG. 4, the capsules 205*a* and 205*b* are introduced into the can and are kept by means 206 in the position illustrated, that is to say chamber 207 facing upward and chamber 215 in the lower position, the lower part of these capsules being immersed in the liquid component S. Thereafter, the can 201 is closed and put under pressure by propellent gas to a sufficient initial value, for example $8\times10^5$ Pa when the reference pressure in the chamber 215 is $7\times10^5$ Pa.

Generally, the plug seals 23 are formed in a material soluble in the liquid component S so that at the end of a certain period, after packaging the can 201, the openings 221 of the capsules 205*a*, 205*b* are freed. Since the pressure prevailing in the can 201 corresponds substantially to that which prevailed in the chamber 220 during storage, the diaphragm 217 of each capsule remains in its plane position and the valves 212 remain closed, as illustrated in FIG. 5.

The can 201, which does not include a plunger tube and which is intended to be used head down, is stored in the head-up position illustrated in FIG. 5. The components S, A and B remain separated from each other.

When the user wishes to form the mixture of the components S, A and B with a view to immediate use, all that he requires to do is to press the push-button 202 of the can 201 kept head up, for a sufficient time, of the order of 5 seconds, in order for propellent gas to escape and for the pressure in the can 201 to drop.

Following this pressure reduction, the diaphragms 217 deform into the convex configuration of FIG. 6 and push back the rod of each valve 212 which opens. The liquid components A and B are drained and are mixed with the liquid component S. The user, by shaking the can 201, facilitates this mixing. When the liquids A and B have been completely discharged from their respective chambers 207, part of the resupply gas contained in these chambers passes through the valve 212 and makes the pressure in the can 201 and in the chamber 220 rise until the valves 212 close.

The can 201 is ready to be used, the extemporaneous mixture S+A+B having been formed.

In order to make this mixture escape, the user turns the can 201 upside down, head down, and presses the button 202.

The method of the invention is suitable, in particular, for oxidation dyes.

The liquid component S may be constituted by a mixture of oxidation dyes in an ammoniacal medium in a vehicle.

In the example of FIG. 1, the component A may be a hydrogen peroxide solution.

The mixture S+A corresponds to the oxidation dye, which may be in the form of a cream, a gel or a foam.

In the case of a three-component mixture (the case in FIGS. 2 and 6), the component S may be a mixture of oxidation dyes in a vehicle, the component A a hydrogen peroxide solution and the component B a reserve of ammonia.

It is quite obvious that the method of the invention, and the pressurized can for the implementation of this method, may be used for numerous applications involving extemporaneous mixtures, for example in the hair-care field, in particular that of permanent waving, in the make-up field, in the skin-care field, in the household or industrial field, in particular for adhesives, mastics or foams, for paints.

It is to be noted that, after releasing the component A, B from the capsule and mixing it with the component S from the can, pressure regulation with the aid of gas under high pressure remaining in the chamber 7, 107, 207 of the capsule is not necessary in all cases. Indeed, a single repressurization may be sufficient to push the mixed product out (the case of a cream, a gel, etc.).

We claim:

1. A method of forming an extemporaneous mixture of at least two liquid or pasty components isolated from each other during storage comprising:

placing a first component in an aerosol can pressurized by a propellant gas;

disposing a resupply capsule in said aerosol can, said capsule comprising a chamber containing a propellant under relatively high pressure, a valve provided in a wall of said chamber, and means for controlling said valve depending on the value of the ambient pressure of said can relative to a reference pressure;

introducing a second component into the pressurized chamber;

installing said capsule formed in the aerosol can;

pressurizing said aerosol can with a propellent gas sufficient for the valve to remain in a closed position during storage;

actuating a dispensing head of said aerosol can with said can in an inverted position so that only said propellent gas escapes from said aerosol can through said dispensing head to bring about a reduction in the pressure of the aerosol can; and having said valve control means cause said valve to open due to the decreased pressure of said aerosol can and allowing said second component to escape from said capsule and to mix with said first component in said aerosol can to form a mixture of the first and second components.

2. A method according to claim 1 wherein said valve comprises a rod and said valve occupies a first closed position when the ambient pressure of said aerosol can is equal to atmospheric pressure, a second closed position when the ambient pressure of said can is at least equal to the operating pressure of the aerosol can, and a transient open position when the valve passes from said first closed position to said second closed position, further comprising disposing said capsule valve down with said rod facing upward so that the second component is expelled when the valve is in the open position.

3. A method according to claim 1 wherein said aerosol can comprises a plunger tube, said dispensing head comprises a push-button, and said dispensing head actuating step includes inverting said aerosol can and pressing said push-button to actuate said dispensing head to allow the propellant gas to escape through the plunger tube out of the aerosol can to bring about a reduction of pressure within the aerosol can sufficient to cause the second component to escape from said capsule thus allowing for the second component to mix with said first component.

4. A pressurized aerosol can containing at least two liquid or pasty components isolated from each other during storage comprising:

a propellant gas for pressurizing said aerosol can;

a first component disposed within said aerosol can;

a resupply capsule disposed within said aerosol can comprising a chamber containing a propellant under relatively high pressure, a valve provided in a wall of said chamber, and means for controlling said valve depending on the value of the ambient pressure of said can relative to a reference pressure;

a second component disposed within the pressurized chamber; and a dispensing head;

wherein the pressure of said propellent gas is sufficient to keep the vane in a closed position during storage keeping the second component separated from the first component and whereby actuating said dispensing head with said aerosol can in an inverted position so that only said propellent gas escapes from said aerosol can through said dispensing head brings about a reduction in the pressure of the aerosol can and causes said valve control means to open said valve due to the decreased pressure of said aerosol can allowing said second component to escape from said capsule and to mix with said first component in said aerosol can to form a mixture of the first and second components.

5. A pressurized can according to claim 4 further comprising a second capsule containing a third liquid component to form a three-component mixture.

6. A pressurized can according to claim 4 further comprising a second capsule containing only propellant gas under pressure to ensure resupply of propellant to the aerosol can to compensate for slight leakages of propellant during storage and wherein the reference pressure of the second capsule being slightly higher that the reference pressure of the first capsule.

* * * * *